US005104516A

United States Patent [19]

de Bruijn et al.

[11] Patent Number: 5,104,516

[45] Date of Patent: Apr. 14, 1992

[54] UPGRADING OIL EMULSIONS WITH CARBON MONOXIDE OR SYNTHESIS GAS

[75] Inventors: Theo J. W. de Bruijn, Constance Bay; H. John Woods, Campbellville, both of Canada

[73] Assignee: Her Majesty The Queen in right of Canada, as represented by the Minister of Energy, Mines and Resources, Ottawa, Canada

[21] Appl. No.: 578,262

[22] Filed: Sep. 6, 1990

[30] Foreign Application Priority Data

Mar. 13, 1990 [CA] Canada ..... 2012071

[51] Int. Cl.[5] ..... C10G 9/00

[52] U.S. Cl. ..... 208/107; 423/650; 423/651; 208/126

[58] Field of Search ..... 208/106, 107, 126; 423/650, 651

[56] References Cited

U.S. PATENT DOCUMENTS 3,929,429 12/1975 Crouch ..... 48/201
4,007,018 2/1977 Slater et al. ..... 48/197 R
4,007,019 2/1977 Slater et al. ..... 252/373
4,309,274 1/1982 Bartholic ..... 423/651
4,504,377 3/1985 Shu et al. ..... 288/106
4,542,114 9/1985 Hegarty ..... 258/106

*Primary Examiner*—Anthony McFarlane
*Attorney, Agent, or Firm*—Nixon & Vanderhye

[57] ABSTRACT

Several procedures are provided herein which reduce the viscosity and density of heavy oils to make them amenable for transportation by pipeline from the field to refineries for further processing. The procedure involves contacting a water emulsion of a heavy oil with carbon monoxide at a pressure range and a temperature range such that a water gas shift reaction takes place to convert the steam and carbon monoxide to hydrogen and carbon dioxide. Simultaneously, a thermal rearrangement takes place, thereby reducing the viscosity and density of the oil without any significant thermal cracking. Under one scheme, at a low temperature range, e.g. below about 400° C., there is substantailly no cracking and minimal molecular changes. Under another scheme, at a higher temperature range, e.g. up to about 460° C., significant cracking and molecular changes take place. Nevertheless under both schemes there is a net production of hydrogen and carbon dioxide, and both hydrogen and carbon dioxide are separated, and may be used in other processes.

29 Claims, 5 Drawing Sheets

UPGRADING OIL EMULSIONS WITH CARBON MONOXIDE OR SYNTHESIS GAS

BACKGROUND OF THE INVENTION (i) Field of the Invention

This invention relates to procedures for reducing the viscosity and density of heavy oils to make them more suitable for transportation by pipeline from the field to refineries for further processing. This invention also relates to processes for the generation of both hydrogen and carbon dioxide by one of two alternative schemes: either only reducing the viscosity and density of the heavy oils to a small extent by minimizing thermal cracking; or totally changing the properties of the heavy oil by operating at typical hydrocracking conditions.

(ii) Description of the Prior Art

The decreasing supply of light conventional crudes is spurring the use of more heavy oils and bitumen. Much of this heavy oil production is transported by pipeline from the field to refineries for further processing. For example, significant quantities of heavy oil are transported from western Canada to the United States where they are used in asphalt production. However, many of the heavy oils produced do not meet the specifications set by the pipeline companies for viscosity, density and bottoms, sediment and water (BS&W). Currently these oils are blended with large amounts of diluent (natural gas condensate or lighter petroleum fractions) to meet the specifications. However, demand and supply predictions for heavy oil and diluents indicate that a shortage in diluent will develop during the 1990's.

An increasing fraction of the heavy oils are being produced by enhanced oil recovery (EOR) techniques, e.g. steamflood, carbon dioxide flooding or fireflood. Natural surfactants present in the oil often result in stable oil-in-water emulsions being formed. In such oil/water emulsion, the water is present as small water droplets in a matrix of oil. Sometimes reverse emulsions are formed wherein the oil is present as small droplets in water as the continuous phase. To meet the pipeline specifications for bottoms, sediment and water (BS&W) generally requires removing the water, which was difficult and involves costly chemical and mechanical treatments. Generally (most) water is removed by a combination of gravity separation (sometimes mechanically aided) and by the addition of demulsifiers to break the emulsion. To remove the last traces of water, more severe measures are often required. In addition, certain emulsions, e.g. fireflood emulsions, are very difficult to break. Removal of the last amounts of water often is accomplished by flash evaporation, i.e., the oil is heated to above the boiling point of water. Finally after a clean, water-free oil has been obtained, the viscosity and density specifications still have to be met to allow transportation by pipeline. Again this is accomplished by mixing the oil with diluent.

The prior art has addressed the problem of how to transport such viscous material, while reducing the diluent requirements, by two general classes of treatment. The first class includes processes that do not affect the oil in any way and use water as a substitute for diluent. The second class includes processes that break up the constituent oil molecules and change its properties, thereby reducing both its viscosity and density. In both classes of treatments, the original emulsion water has to be separated first.

Processes in the first class reduce the viscosity by mixing the oil with water and surfactants to prepare an oil-in-water emulsion. This emulsion must be stable enough to withstand the diverse conditions it encounters in the pipeline system, e.g., the high shear stresses in the pumps, yet be easy to break at its destination.

Transportation of the oil using core annular flow is another proposed concept. Here an artificially created film of water surrounds the oil core concentrically. This reduces the viscosity and pressure drop almost to that which would be expected for water. These processes require that, where field emulsions are produced, these emulsions be broken first. Water, and in the case of emulsion transport, surfactants, are then added and mixed under controlled conditions to obtain a stable emulsion or core flow. In all cases where diluents or water are used, a significant part of the capacity of the pipeline is being taken up by a non-heavy oil component, significantly adding to the cost of the system. In the case of water, it might also create a disposal problem at the receiving end of the pipeline, and in the case of diluent, return lines will often be required to transport the diluent back to the field to be mixed again with heavy oil.

Processes in the second class alter the oil properties significantly and are generally of the carbon rejection or hydrogen addition type. Both procedures employ high temperatures (usually > about 430° C.) to crack the oil. In the carbon rejection processes, the oil is converted to lighter oils and coke, while in the hydrogen addition processes the formation of coke is prevented by the addition of high pressure hydrogen. In some coke rejection processes, the coke is burned or gasified to provide heat, or fuel that can be used elsewhere in the process. Both of these upgrading processes significantly increase the distillate yields, because of the thermal cracking of the heavy oil molecules that takes place, which results in significantly altered molecular weight structures and properties. However, because of the extensive cracking that takes place, these high conversion processes destroy the asphalt properties that many of the original heavy oils exhibit. This is a serious concern since asphalt is a high priced commodity.

All hydrogen addition processes require hydrogen to allow the process to proceed without coke formation. Some hydrogen addition processes are described in the prior art that use coke or effluent streams to generate carbon monoxide, which in turn is used to make hydrogen.

For example, U.S. Pat. No. 2,614,066, patented Oct. 14, 1952 by P. W. Cornell, provided a continuous method of hydro-desulfurization, in which the hydrogen utilized in the process was largely obtained from contaminant produced concomitant with the hydrodesulfurization process. The patented process comprised removing sulfur from petroleum hydrocarbons containing sulfurous material at an elevated temperature with a hydrogen-containing gas in the presence of a contact material having hydrogenating characteristics, cooling the effluent to obtain a first gas portion and a hydrocarbon liquid portion containing dissolved gases, separating the hydrocarbon liquid portion, and removing the dissolved gases from the hydrocarbon liquid to form a second gas portion. Substantial amounts of the hydrocarbon portion of this second separated gas portion were then converted into hydrogen through a reforming and shift reaction. The formed hydrogen was recycled for the hydrodesulfurization of the feed petroleum hydrocarbons.

U.S. Pat. No. 3,413,214, patented Nov. 26, 1968 by R. B. Galbreath, provided for the hydrogenation of liquid hydrocarbons which was carried out in the presence of hydrogen and a controlled amount of oxygen to hydrogenate a major portion of the liquid hydrocarbon feed and to oxidize a minor portion thereof, thereby producing a gaseous product containing carbon monoxide. The carbon monoxide content of the gaseous product was subsequently reacted with steam in a separate reactor to form additional hydrogen which was recycled to the hydrogenation zone.

U.S. Pat. No. 3,694,344, patented Sept. 26, 1972 by W. H. Monro, provided a combination process in which a hydrocarbonaceous charge stock was reacted with steam to produce an effluent containing hydrogen and carbon oxides. The relatively low pressure effluent was compressed to an intermediate pressure level, at which pressure the hydrogen concentration was increased through the removal of the oxides of carbon. The purified hydrogen stream was then compressed to a higher pressure level and was introduced into the hydroprocessing reaction zone.

U.S. Pat. No. 4,207,167, patented June 10, 1980 by R. W. Bradshaw, provided a process wherein a used hydrocarbon cracking catalyst having coke laydown thereon was regenerated under conditions to produce a gas rich in carbon monoxide which, together with steam, was subjected to a shift reaction to produce carbon dioxide and hydrogen. Oil cracked with such catalyst produced vapors which were fractionated to yield gases, cracked gasoline, a light-cycle oil, a heavy-cycle oil and bottoms, at least one of the light and heavy cycle oils is hydrocracked with the hydrogen earlier produced.

U.S. Pat. No. 4,569,753, patented Feb. 11, 1986 by L. E. Busch, et al, provided a combination process for upgrading residual oils and high boiling portions thereof comprising metal contaminants and high boiling Conradson carbon forming compounds. The process comprised a thermal visbreaking operation with fluidizable inert solids followed by a fluidized zeolite catalytic cracking operation processing demetallized products of the visbreaking operation. Solid particulate of each operation were regenerated under conditions to provide carbon monoxide rich flue gases relied upon to generate steam used in each of the fluidized solids conversion operation and downstream product separation arrangements. The wet gas product stream of each operation was separated in a common product recovery arrangement. The high boiling feed product of visbreaking comprising up to 100 ppm Ni+V metal contaminant was processed over a recycled crystalline zeolite cracking catalyst distributed in a sorbent matrix material.

Canadian Patent No. 1,195,639, issued Oct. 22, 1985 by H. S. Johnson, et al, provides a process for upgrading heavy viscous hydrocarbonaceous oil. The patented process involves contacting the oil with a carbon monoxide-containing gas and steam in a reaction zone at hydrocracking conditions, such hydrocracking conditions including a temperature of at least about 400° C. and a pressure between substantially 5 MPa and 20 MPa, in the presence of a promoted iron catalyst, to yield a hydrocracked product. The required hydrogen to prevent coke formation was made from carbon monoxide and added water inside the upgrading reactor. No hydrogen or carbon dioxide was recovered.

Canadian Patent No. 1,124,195, issued to Khulbe et al, describes a hydrocracking process that operates from about 400° to about 500° C., where synthesis gas is used to supply the hydrogen for the cracking reactions. The synthesis gas was made in a separate reactor.

None of the patented processes described above are suitable for reducing both the viscosity and density of heavy oils without substantially breaking up the constituent molecules of the oil. In all the hydrocracking processes described above, the oil properties were changed significantly. Furthermore, in none of the described processes, was hydrogen and carbon dioxide recovered separately for use in alternative processes.

SUMMARY OF THE INVENTION

(i) Aims of the Invention

One object of the present invention is to provide a thermal rearrangement process whereby the viscosity and density of heavy oils are reduced to make the heavy oils more amenable for transportation by pipeline.

Another object of this invention is the provision of such process wherein significant amounts of hydrogen gas are recovered.

Yet another object of this invention is the provision of such process wherein significant amounts of carbon dioxide are recovered.

Still another object of this invention is the provision of such a process wherein a major part of the water present in heavy oil emulsions is converted into hydrogen.

(ii) Statements of Invention

The present invention is based upon the treatment of heavy oil water emulsions with carbon monoxide under water gas shift reaction conditions, and recovering both hydrogen and carbon dioxide and recycling carbon monoxide.

This invention provides a process for the thermal rearrangement of heavy oils in heavy oils-in-water emulsions, which process comprises: contacting the emulsion with carbon monoxide in the presence of a catalyst, under such conditions of pressure and temperature that a water gas shift reaction occurs; and recovering thermally rearranged liquid oil having a lower viscosity and lower density, gaseous carbon dioxide and gaseous hydrogen therefrom.

(iii) Other Features of the Invention

The overall process of this invention has a net hydrogen production. The hydrogen is produced by the water gas shift reaction:

$$CO + H_2O \rightleftharpoons CO_2 + H_2$$

The temperature may be within the range of about 250° to about 460° C.; or within the range of about 375° to about 400° C.; or within the range of about 400° to about 460° C.

The pressure may be within the range of about 100 to about 3000 psi; or within the range of about 500 to about 1500 psi.

The gas-to-liquid ratio may be within the range of about 9 l/kg to about 3500 l/kg. The carbon monoxide/water ratio preferably is about 0.3 to about 3.0. The space velocity may be within the range of about 0.1 to about 20 per hour.

The catalyst may be an iron compound, e.g. iron oxide, iron sulphate, iron sulphide or iron-containing waste material; or it may be a typical water gas shift catalyst, e.g. a Fe/Cr or Co/Mo catalyst. Preferably the catalyst is present in an amount of about 0.03 to about 5 wt %. A promotor, e.g. an alkali metal carbonate or an alkali metal sulphide, e.g. potassium carbonate, may be included in an amount in the ratio of about 0.01 to about 0.2 to said catalyst.

The carbon monoxide may be in the form of a mixture of carbon monoxide and hydrogen. The process preferably also includes the step of recovering CO formed in situ for recycling to use as carbon monoxide in the process.

The carbon dioxide produced may be removed by a scrubbing process or by a pressure swing absorption process or membrane separation process.

The hydrogen produced may be purified by a scrubbing process, or by a pressure swing absorption process, or by a membrane separation process.

The process is preferably carried out to a pitch conversion of less than about 20 wt %, when the original properties of the heavy oil feedstock are to be preserved. If the preservation of the original properties is not the objective, pitch conversions greater than about 20% may be used.

Thus in embodiments of this invention, the heavy oil-in-water emulsion is contacted with carbon monoxide. The mixture is brought to reaction pressure and heated to reaction temperature, where, preferably, in the presence of a catalyst, the carbon monoxide and water react to form in-situ hydrogen. The process can operate in three temperature ranges depending on whether emulsion breaking only, or emulsion breaking combined with viscosity reduction (without affecting the structure of the oil components to a large extent) or high distillate yields are the objective. The range of operating conditions according to aspects of this invention are as follows: temperature, about 250° to about 460° C.; space velocity, about 0.1 to about 20 per hour; carbon monoxide/water rates, about 0.3 to about 3.0; and pressure, about 0.8 to about 20.8 MPa (about 100 to about 3000 psig).

At the intermediate range of temperatures, (about 300° to about 400° C.) described above, the water gas shift reaction starts to occur in the oil phase. One important aspect of this invention is specifically designed to operate in such temperature region. Water is not just separated but is converted to valuable hydrogen, while the oil properties that are important for pipelining are improved without significantly altering the molecular structures. The change in oil properties is the result of thermal rearrangement, e.g., hydrogenating unsaturated bonds, and breaking off some side chains, but without substantial breaking up the constituent molecules into small fragments (gas).

Cracking starts to become predominant above about 400° C. or above about 20 wt % pitch conversion. An indication of cracking and breaking up of the constituent molecules into small fragments is that the gas make (hydrocarbons and hydrogen sulphide) rapidly increases above about 20 wt % pitch conversion. One aspect of the present invention operates under control of the temperature and pressure conditions to avoid pitch conversion over about 20 wt %.

In the high temperature range (about 400° to about 460° C.) the water gas shift reaction occurs very rapidly, though the equilibrium becomes slightly less favourable. Towards higher temperatures, more of the hydrogen is being used in hydrogenation reactions and to cap radicals formed by thermal cracking reactions. However, under the proper conditions, a net hydrogen production still results. The oil properties change very significantly, destroying the properties of the original oils. Distillate yields and pitch, sulphur and CCR conversion increase, while viscosity and density are further reduced.

An intrinsic advantage of the present invention is that it is an environmentally benign process that can be an emulsion breaking process alone. However it is primarily intended to be a low cost combined emulsion breaking/viscosity reduction process which breaks the emulsion and simultaneously reduces substantially or even eliminates the need for diluent by reducing the viscosity and density of the resulting oil. At the same time, it minimizes changes to the heavy oil structures and produces valuable hydrogen and carbon dioxide gases from the water and carbon monoxide. Alternatively, it can be an emulsion breaking/high severity upgrading process that significantly changes the heavy oil properties but increases distillate yield and conversions. Thus, in the last two cases, the emulsion is broken not only by just removing the water but also by converting it to valuable hydrogen, thereby reducing waste water. Furthermore, the hydrogen produced can be used in other processes to upgrade secondary streams, e.g., naphtha or gas oils, or used in fuel cells, while the carbon dioxide produced could be used for enhanced oil recovery (carbon dioxide flooding).

The product can be separated in whatever scheme is convenient. Often the product is separated into two or more stages. By proper selection of the last stage, a mainly pitch-containing stream could be produced that would contain all solids and could be used for gasification to produce a carbon monoxide-containing gas for use in the reactor to convert the water. The gases can be separated in any suitable separation process and to the extent that is required for the particular application. For example, the stream could be separated into hydrogen, carbon monoxide and carbon dioxide. The hydrogen could be used for further upgrading of the oil products or fraction of it, in other processes, e.g. hydrocracking, hydrotreating, or may be used in different applications, e.g. fuel cells. The carbon monoxide is recycled to the reactor, while the carbon dioxide could be used to enhance the recovery of the heavy oil. The waste streams from the process are virtually non-existent. A waste stream from one part is a valuable reactant in another part, e.g., the water in the emulsion.

As mentioned briefly previously, the carbon dioxide made from the reaction can, after removal by, for example, a scrubbing process or a pressure swing absorption process, or a membrane separation process, be used in other processes to improve enhanced oil recovery processes. Many commercial processes currently use enhanced oil recovery techniques whereby the oil field is flooded with carbon dioxide (miscible or immiscible). In the U.S.A., carbon dioxide gas wells are present at several places that can supply the required quantities. In Canada (Alberta and Saskatchewan), however, no carbon dioxide wells are available. This integrated process embodiment of the present invention could provide a ready supply of carbon dioxide which would be close to the locations where it is required.

As mentioned briefly previously, the present invention preferably operates in two temperature ranges, namely about 330° to about 400° C. or about 400° to about 460° C. In these ranges, the water gas shift reaction converts the water to hydrogen, while simultaneously the viscosity is significantly reduced and the extent of thermal cracking minimized (first range), or high distillate yields are produced (second range). Only a very small fraction of the hydrogen is used in reactions with the heavy oil; the extent depends on the temperature and the catalyst. Overall, the process of the present invention is a significant net producer of hydrogen, which can be used in other processes to upgrade (hydrotreat) distillate streams from the oil, or be used for other purposes, e.g. fuel cells.

The process of the present invention can be used to break any emulsion irrespective of the oil properties and whether it is an oil-in-water or a water-in-oil emulsion, a field emulsion or an artificially created emulsion. It can be used to reduce the oil viscosity and density, substantially to eliminate or to reduce the diluent requirements, or increase distillate yields and reduce the content of pitch, sulphur and the like.

The gas used to convert the water is preferably carbon monoxide but can be a mixture of carbon monoxide and hydrogen (for example, synthesis gas). When such gas is used, the extra hydrogen does not provide any benefits in terms of emulsion breaking or reducing the viscosity and density of the oil. It will negatively influence the equilibrium of the water gas shift reaction. However, it is believed that synthesis gas would be easier to make than pure carbon monoxide. However, any source of carbon monoxide would suffice; it could even be generated in situ by decomposing a precursor thereof, e.g., methanol.

As mentioned briefly previously, the concentration or pressure of carbon monoxide should be optimized to convert as much water as possible. At very low pressures, the carbon monoxide concentration in the liquid phase might become the limiting factor in the water conversion. A range of about 0.8 to about 21 MPa (about 100 psi to about 3000 psi) is possible though about 500 to about 1500 psi is preferred. The final choice will depend on the relation between space velocity, temperature and pressure for the particular feedstock in question. In general, the process operates at gas to liquid ratios of about 9 l/kg to about 3500 l/kg. The space velocity or residence time can range from about 0.1 to about 20 per hour or about 10 hours to about 3 minutes, respectively, depending on whether the process is executed as a continuous or batch operation. The temperature will range from about 250° C. to about 460° C.

The catalyst can contain an iron compound, e.g., iron oxide or sulphate. In the reaction zone, the iron salt can convert to an iron sulphide compound. The concentration of the catalyst can vary widely, depending in general on its surface area. Less catalyst would be required if it was finely divided than when it was very coarse. The concentration of the catalyst could range from about 0.03 to about 5 wt % depending on the type of salt and its dispersion. Promotors are added to facilitate the water-gas shift reaction. Typical promotors include alkali metal carbonates and sulphates. A typical promotor is potassium carbonate. The promotor may be added in a ratio of about 0.01 to about 0.2 to the catalyst. The catalyst and promotor are in a finely divided form and are mixed with the emulsion prior to entering the reactor. The catalyst would normally be smaller than 1 mm, unless the catalyst would break up under the reaction conditions. No lower limit is required.

In addition to inexpensive iron salts, or iron-containing waste materials, typical water gas shift catalysts, e.g., Fe/Cr or Co/Mo catalysts may be used. They can advantageously affect the water conversion and promote more or less cracking, if so desired.

BRIEF DESCRIPTION OF THE DRAWINGS

In the accompanying drawings.

Figure 1:
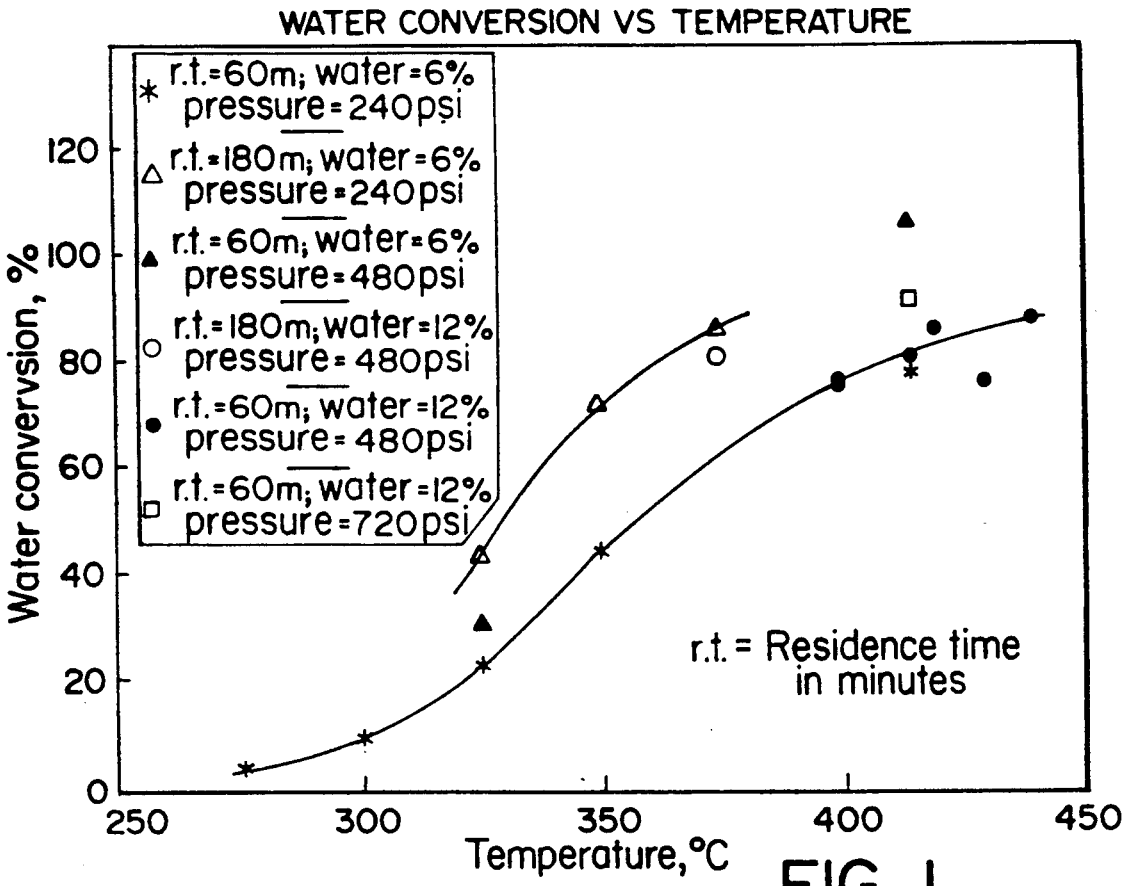
FIG. 1 is a graph of water conversion in % as ordinate vs temperature, in °C. as abscissa.

The process of aspects of this invention will now be further described by the following examples, which illustrate typical embodiments of the invention.

DESCRIPTION OF PREFERRED EMBODIMENTS

Examples

In the following examples of this invention, the following equipment was used:

For batch runs, a 2-L 316 SS batch autoclave from Autoclave Engineers was used. It was equipped with a MAGNEDRIVE TM stirrer with a 3.2 cm diameter, 6-blade impeller.

For semi-continuous runs, the batch autoclave setup was converted to one where a continuous flow of gas and water was fed into a fixed emulsion charge.

A series of experiments was carried out on a Pelican Lake emulsion in the batch autoclave. These experiments were followed by a series of semi-continuous runs with Pelican Lake and three other emulsions to obtain more product for more detailed analyses. The emulsions used, and their water content are given below in Table 1:

TABLE 1

| Emulsion | Process | Water Content |
|---|---|---|
| Pelican Lake | steamflood | 6.2 wt % |
| Tangleflags | fireflood | 19.6 wt % |
| Wolf Lake | steamflood | 4.9 wt % |
| Cold Lake | steamflood | 31.0 wt % |

The water was distilled out and the resulting water free heavy oils analyzed. The analysis of the water-free heavy oils used in the following examples is shown below in Table 2.

TABLE 2

| Analysis of Water-Free Heavy Oils | | Pelican | Tangle-flags | Wolf Lake | Cold Lake |
|---|---|---|---|---|---|
| Density | ASTM D4052 | 0.9682 | 0.9850 | 0.9961 | 1.0095 |
| API Gravity | | 14.6 | 12.2 | 10.6 | 8.7 |
| Viscosity, cSt | ASTM D445 | | | | |
| 25 C. | | 989.0 | — | — | — |
| 40 C. | | 342.0 | 2753 | 5278 | 35596 |
| 100 C. | | — | 73.3 | 93.0 | 292.5 |
| Carbon, wt % | Elemental | 82.84 | 83.93 | 84.60 | 84.51 |
| Hydrogen, wt % | Elemental | 11.49 | 11.73 | 11.21 | 11.06 |
| Hydrogen/carbon ratio | | 1.65 | 1.67 | 1.58 | 1.56 |
| Nitrogen, ppm | ASTM 3431 | 3044 | 3196 | 4190 | 4664 |
| Sulphur, wt % | GCM 100 | 4.96 | 4.18 | 4.55 | 4.73 |
| Ash, wt % | ASTM D482 | 0.07 | 0.50 | 0.06 | 0.25 |
| Conradson carbon, wt % | ASTM D189 | 9.81 | 12.42 | 13.16 | 14.81 |
| Metals, ppm | ICP | | | | |
| Vanadium | | 120 | 99 | 140 | 150 |
| Iron | | 11 | 33 | 7.9 | 12 |
| Copper | | <2 | <2 | <2 | <2 |
| Pitch +500 C., wt % | Spinning Band | 50.17 | 51.71 | 55.60 | 61.64 |

Table 2 indicates that "oil quality" with respect to viscosity, density, Conradson Carbon, nitrogen and pitch content decreases in the order of Pelican>Tangleflags>Wolf Lake>Cold Lake. The Pelican crude contained the highest concentration of sulphur. Therefore it was expected that Pelican should require the least upgrading to achieve the pipeline specifications, shown in Table 3 below:

TABLE 3

| Typical Pipeline Specifications For Crude Oil | API values | Metric equivalent |
|---|---|---|
| Viscosity, cSt (max.) | | |
| 70 F. | 118 | 88.8 @25 C. |
| 100 F. | 48 | 43.5 @40 C. |
| Pour point, F. (max) | 25 | −4 C. |
| BS&W (max.) | 0.5 | 0.5 |
| Gravity (min.) | 20 | — |
| Density, g/cc (max) | — | 0.934 |

The startup procedures were the same for the batch and semi-continuous runs. The autoclave was charged with the emulsion and catalyst, sealed, purged and pressure tested with nitrogen. The nitrogen was discharged and the vessel was purged with carbon monoxide.

The procedures for the batch and semi-continuous runs then differed as follows:

For the batch runs, the vessel was pressurized with carbon monoxide to the desired pressure at ambient conditions that would result in the required pressure at operating conditions. The autoclave was stirred at 1500 rpm, heated to the reaction temperature and maintained at that temperature for the duration of the run. At the end of the run, the gas was cooled to room temperature and discharged into a MYLAR TM bag. Its volume was measured and its composition was analyzed by gas chromatography.

For the semi-continuous runs the pressure was raised to 7.0 MPa (1015 psi) with carbon monoxide and the gas flow was adjusted to 1.25 L/min at operating conditions. Water injection was started at approximately 380° C. At 10° C. below the final operating temperature, gas collection was started and the volumes of water and hydrocarbons collected in the receiver, and water injected at that point were noted.

In calculating the water in the system during the run, this mass of water collected at the start of the run was subtracted from the total of the water injected and water originally present in the emulsion. After the run, when cooling, and the temperature was 10° C. below the operating temperature, the total water injected and the water and hydrocarbons collected were again recorded.

For both types of runs, the liquid was removed from the autoclave, then weighed and analyzed by GCD. Residue in the vessel and on the stirrer and thermowell was removed by washing with methylene chloride and scraping. The combined washings were filtered to recover the catalyst and the filtrate was distilled to remove the methylene chloride. The bulk liquid as recovered was analyzed for water Dean and Stark and infrared spectroscopy and for BS&W. Samples were centrifuged to remove catalyst fines prior to determining density and viscosity.

The range of operating conditions are shown below in Table 4.

TABLE 4

| Operating Conditions For Batch Autoclave | |
|---|---|
| Temperature, C. | 275–440 |
| Residence time, min | 60–180 |
| $CO/H_2O$ ratio | 1.06–2.24 |
| Pressure | |
| MPa | 5.3–19.1 |
| psig | 750–2750 |

Some of the results of selected batch runs are given below in Table 5:

TABLE 5

| Summary of Selected Batch Results | Run | | | | | |
|---|---|---|---|---|---|---|
| | 6 | 7 | 8 | 14 | 19 | 20 |
| Temp. | 375° C. | 375° C. | 375° C. | 375° C. | 375° C. | 375° C. |

TABLE 5-continued

| Summary of Selected Batch Results | | | | | | |
|---|---|---|---|---|---|---|
| | Run | | | | | |
| | 6 | 7 | 8 | 14 | 19 | 20 |
| Catalyst | Fe2O3 | none | none | none | Fe/Cr | Co/Mo |
| Residence time, m | 180 | 180 | 180 | 180 | 180 | 180 |
| Pressure, psi | 1020 | 900 | 1450 | 965 | 1960 | 1890 |
| Water content, % | 6.80 | 6.80 | 6.80 | 5.88 | 11.68 | 11.66 |
| Water conversion, % | 85 | 19 | 33 | 0.56 | 82 | 74 |
| Viscosity, @25 C. cSt | 162.72 | 86.55 | 117.50 | 71.12 | 240.83 | 145.51 |
| Density | 0.9542 | 0.9509 | 0.9519 | 0.9496 | 0.9600 | 0.9518 |
| Conversion, % | 21.25 | 21.05 | 21.05 | 24.76 | 15.79 | 21.44 |
| Gas make, % | 0.58 | 0.92 | 0.91 | 1.17 $N_2$ | 0.55 | 1.22 |

As seen by comparison of runs 6 and 7, without catalyst, the water conversion is only 19% vs 85% with catalyst. The catalyst speeds up the water gas shift reaction. The cracking appears to be affected by the presence of the iron oxide catalyst, as reflected in gas make (0.58 vs 0.91%). Product viscosity (162.7 vs 86.55 cSt) and density (0.9542 and 0.9509) are significantly different, indicating that the hydrogen that forms in situ is very reactive and probably caps radicals that are formed and stabilizes them, preventing them from cracking any further, resulting in the lower gas make and higher viscosity and density.

The data shows that, even without catalyst, some of the water is converted, probably because every heavy oil contains metal atoms that can act as a catalyst. A process without the addition of catalyst is therefore possible, particularly if the feedstock contains large concentrations of metals. The reaction rate is, however, fairly slow and longer residence times or higher temperatures would be required. Alternatively, the pressure could be increased.

As seen in Run 8, when the pressure was increased to approximately 10.0 Mpa (1450 psi) from 6.2 MPa (900 psi), with no catalyst used, the water conversion increased from 19 to 33%, while the viscosity and density increased from 86.55 to 117.50 cSt and 0.9509 to 0.9519, respectively.

The increased water gas shift reaction inhibited the cracking reactions. The effect of the water gas shift reaction also becomes clear by consideration of the results from run 14 in which no catalyst, and nitrogen, instead of carbon monoxide, were used. Water conversion did not occur (0.6%) and pitch conversion and gas make are higher and viscosity and density are lower. More cracking took place because the water gas shift reaction did not take place.

As shown above, the extent of cracking is affected by the presence or absence of a catalyst. Different types of catalyst can also affect the process differently. In runs 19 and 20, commercial water gas shift catalysts (iron/-chromium, KATALCO TM C71-2 Co/Mo, and TOPSOE TM Tk 550) were employed, the water conversion was similar to the cheap iron oxide employed. The Fe/Cr appears to inhibit cracking somewhat more than the iron oxide as reflected in the lower pitch conversion and higher viscosity.

The following general trends were observed in a series of experiments performed in the batch autoclave with Pelican Lake and with an iron oxide catalyst with potassium carbonate as promotor. The water conversion is shown in FIG. 1. The reaction starts to occur at 250° C. and levels off at 375°–400° C., depending on the conditions because the reaction reaches equilibrium. For temperatures above 375° C., 80–90 wt % of the water has been converted. The trace of water remaining is easily separated from the oil because the natural surfactants that caused the emulsion in the first place have cracked or otherwise reacted away.

Figure 2:
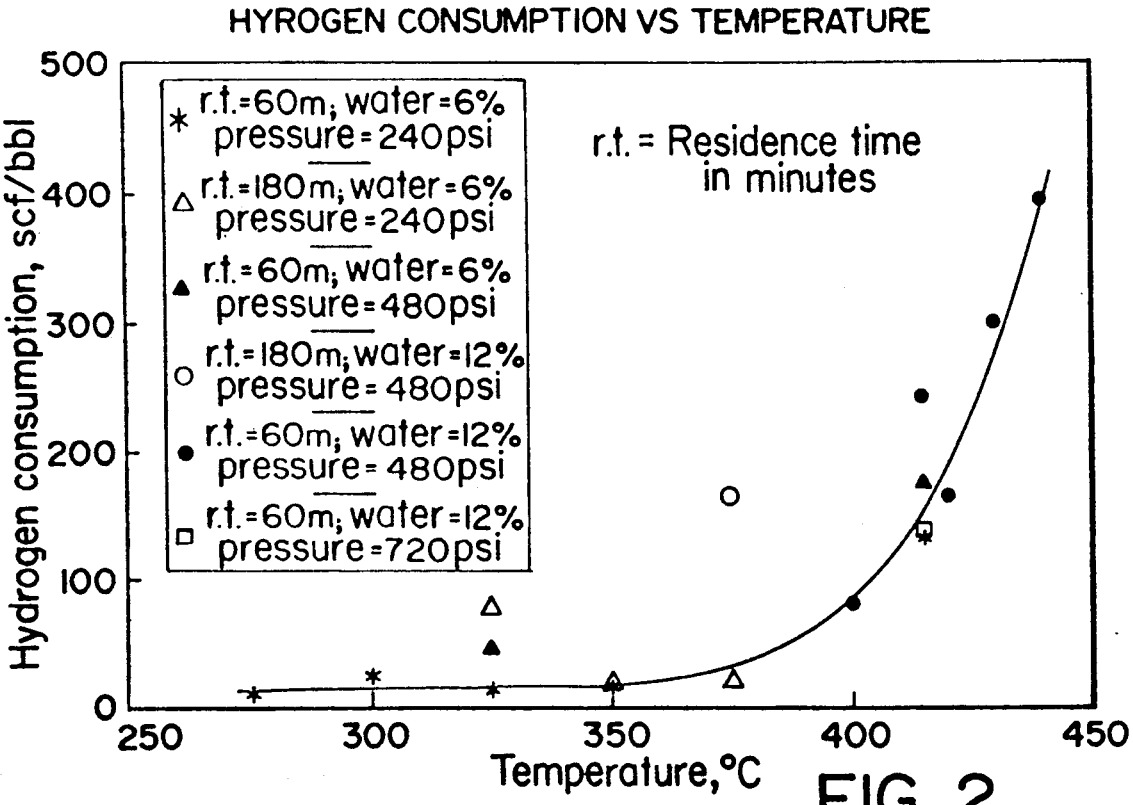
FIG. 2 is a graph of hydrogen consumption in scf/bbl as ordinate vs temperature, in °C. as abscissa.

As shown in FIG. 2, a shift in the equilibrium because hydrogen reacts away is unlikely because at these low temperatures hydrogen consumption is minimal. For low water content and low pressure, the hydrogen consumption is negligible up to 375°–390° C.; for higher residence times and water concentrations, the hydrogen consumption appears somewhat higher, though at higher temperatures the effect is unclear.

Figure 3:
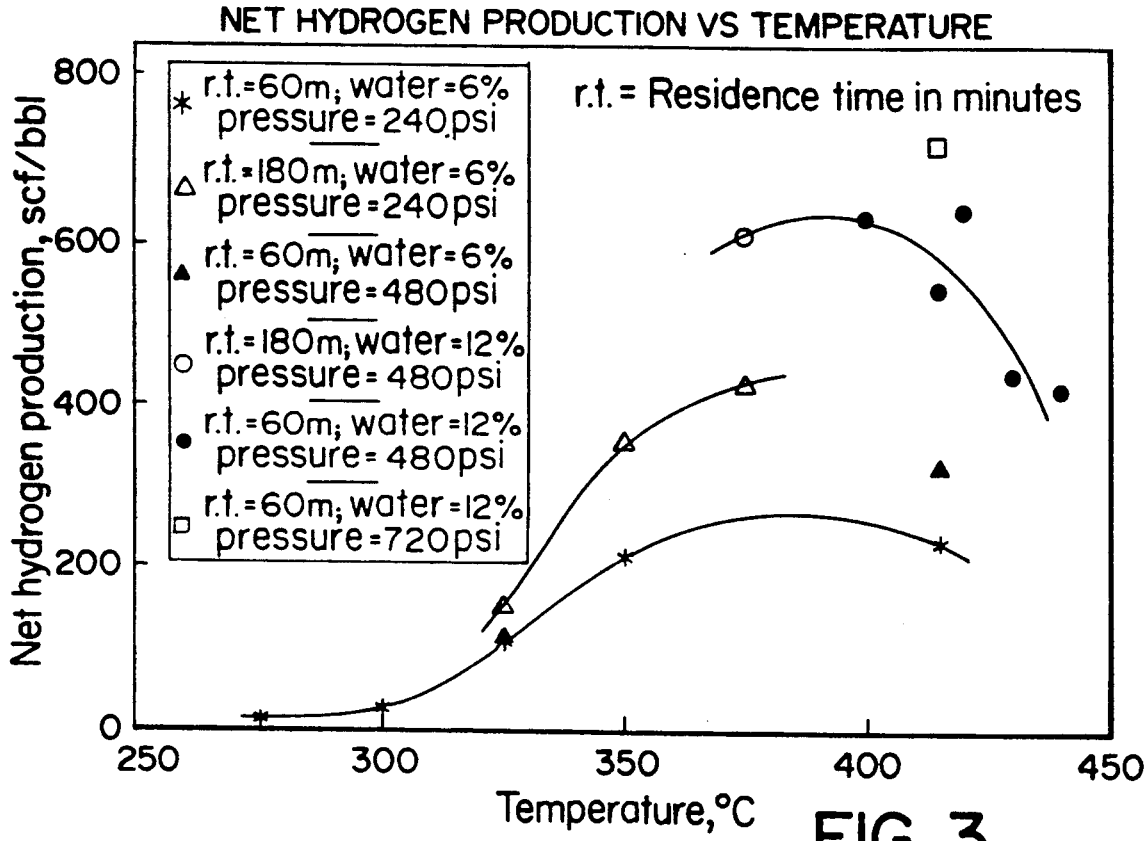
FIG. 3 is a graph of net hydrogen production, in scf/bbl as ordinate vs temperature, in °C. as abscissa.
Figure 4:
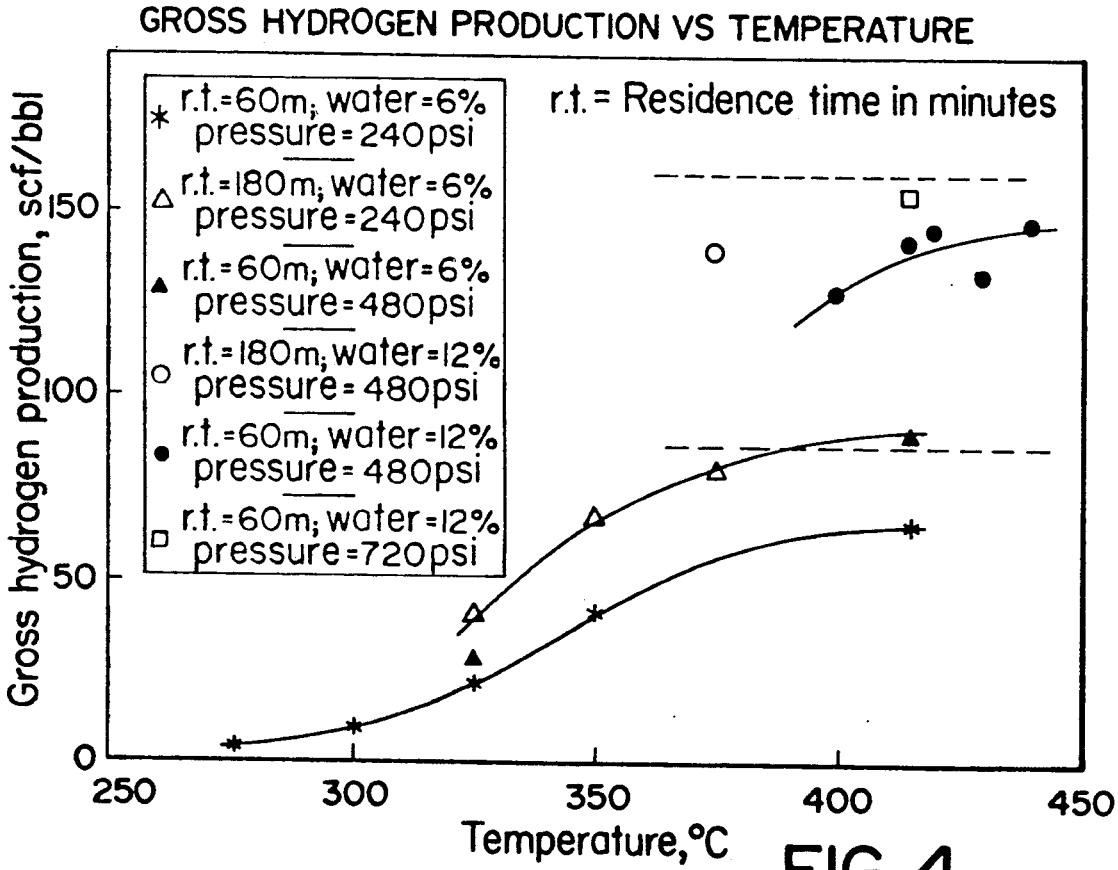
FIG. 4 is a graph of gross hydrogen production, in scf/bbl as ordinate vs temperature, in °C. as ordinate.

The net hydrogen production is plotted versus temperature in FIG. 3. It is seen that there is a definite influence of the operating conditions other than temperature. All lines in FIG. 3 exhibit a maximum at approximately 390°–400° C., above which the hydrogen consumption starts to increase a result of increased thermal cracking. (See FIG. 2). The increased hydrogen consumption results in a decreased net hydrogen production at these temperatures. This is the third temperature region, and the region of the hydrocracking (hydrogen addition) processes. In this region, the properties of the heavy oil are significantly changed. It should be noted though that, even at high temperatures of 440° and 450° C., where thermal cracking and hydrogenation reactions are fast and extensive, the process of this aspect of this invention still results in a net hydrogen production. The effect of the operating variables on the net hydrogen production is the result of their effect on the gross hydrogen production, i.e., their effect on the water-gas shift reaction, which is shown in FIG. 4.

Figure 5:
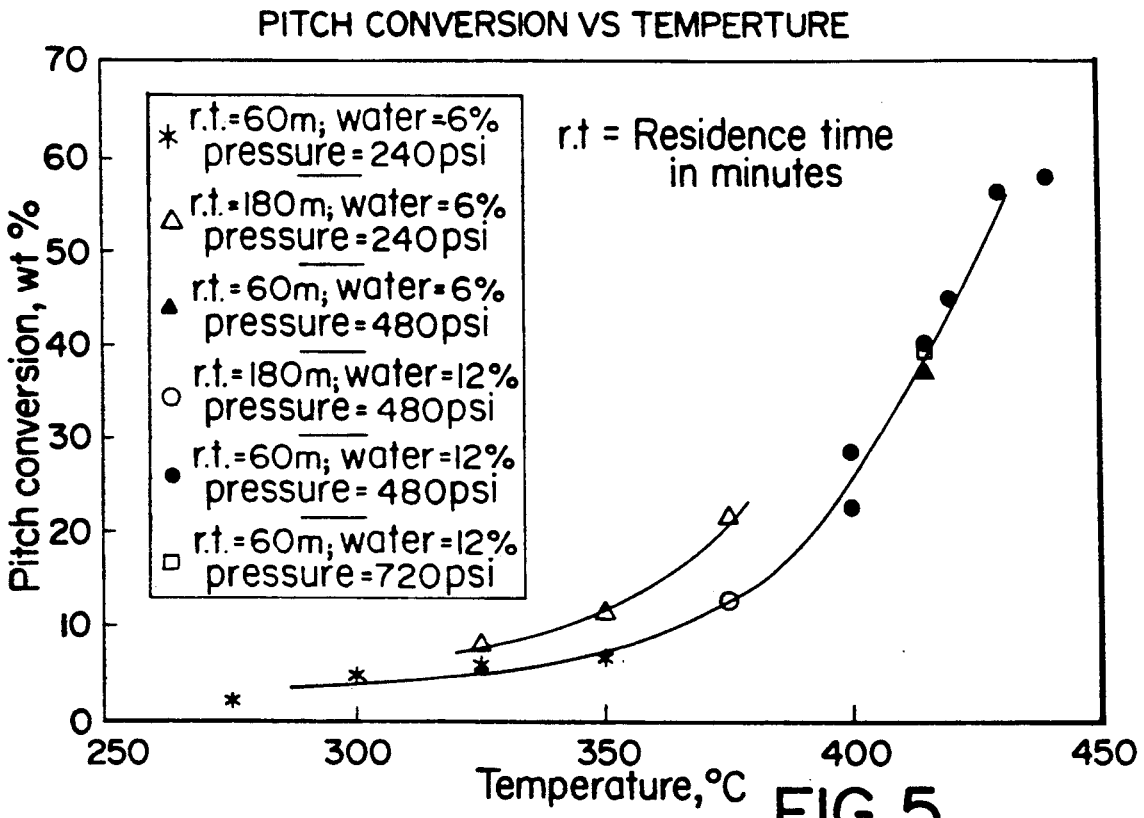
FIG. 5 is a graph of pitch conversion, in wt % as ordinate vs temperature in °C. as abscissa.

An indication of the extent of cracking is provided by the pitch conversion which is shown in FIG. 5. As seen in FIG. 5, the pitch conversion dramatically increases at temperatures above 400° C. FIG. 5 shows the pitch conversions versus temperature that were obtained for all experiments, covering a wide range of conditions, e.g., residence times, water contents, CO concentrations. Given this wide range of conditions, there is not very much variation in conversion, indicating that the pitch conversion is determined to a major extent by thermal cracking. A small difference occurs because of a different residence time. Water or CO concentrations hardly appear to have an effect.

Figure 6:
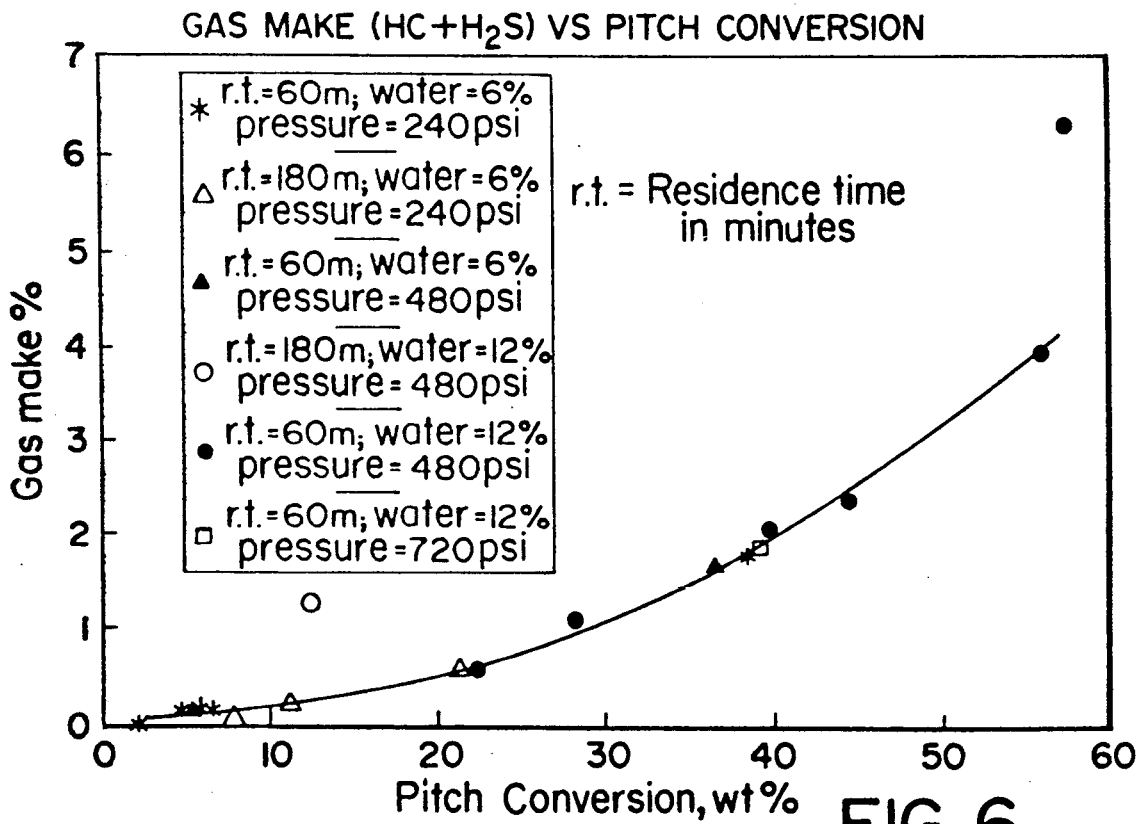
FIG. 6 is a graph of gas make, in % as ordinate vs pitch conversion, in wt % as abscissa.

Another indication of severe cracking is the gas make (hydrocarbons and hydrogen sulphide) which is shown in FIG. 6. It rapidly increases above 20 wt % pitch conversion, i.e. above 400° C.

Figure 7:
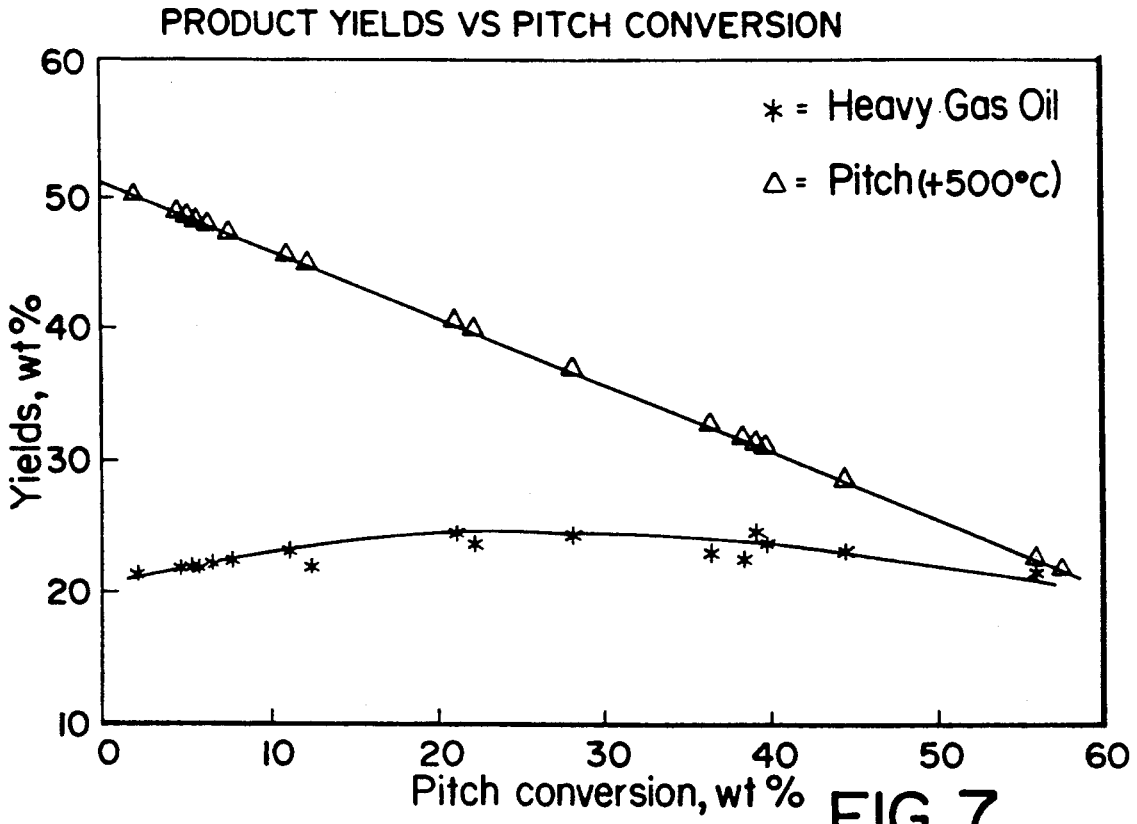
FIGS. 7 and 8 are graphs of yields, in % as ordinate vs pitch conversion, as abscissa.

FIG. 7, which shows the heavy gas oil yield, indicates that some of the gas oil is being cracked at these temperatures. The heavy gas oil yield shows a maximum at approximately 20 wt % pitch conversion. This is the range of conditions that should be avoided if only emulsion breaking and viscosity reduction are the objective.

Figure 8:
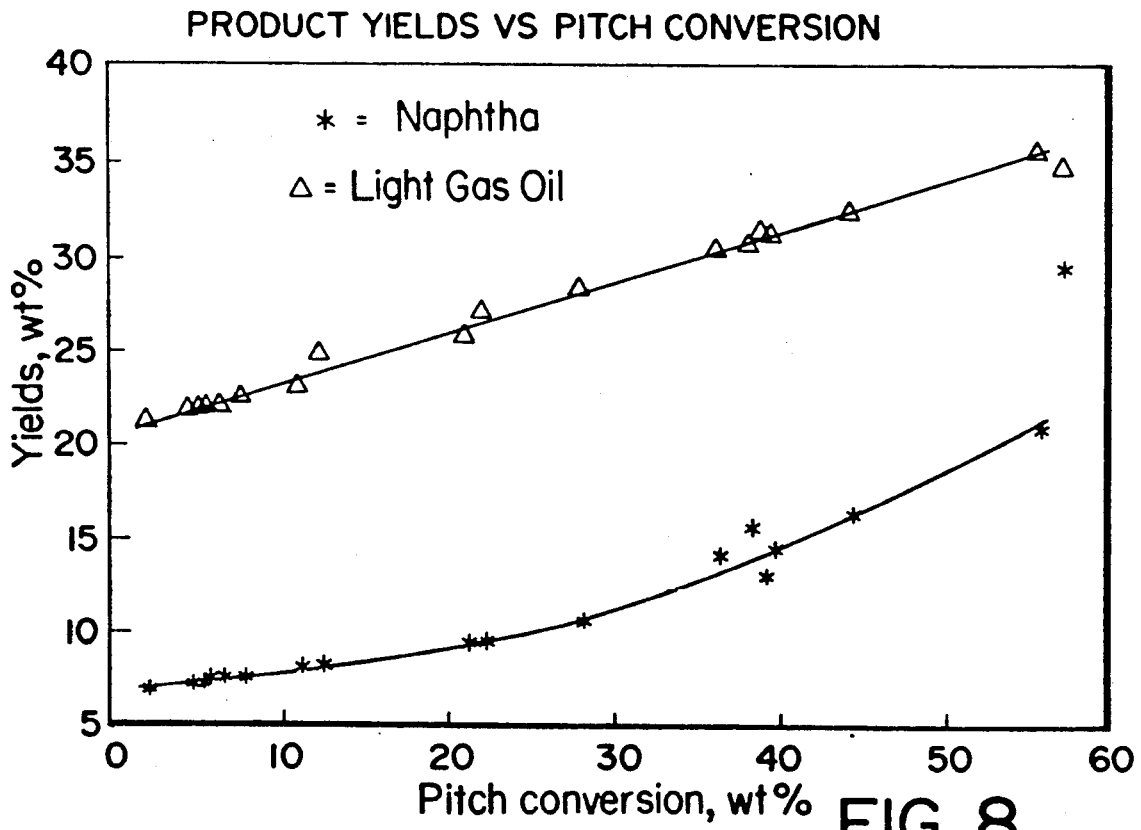

The naphtha and light gas oil yields are given in FIG. 8.

Figure 9:
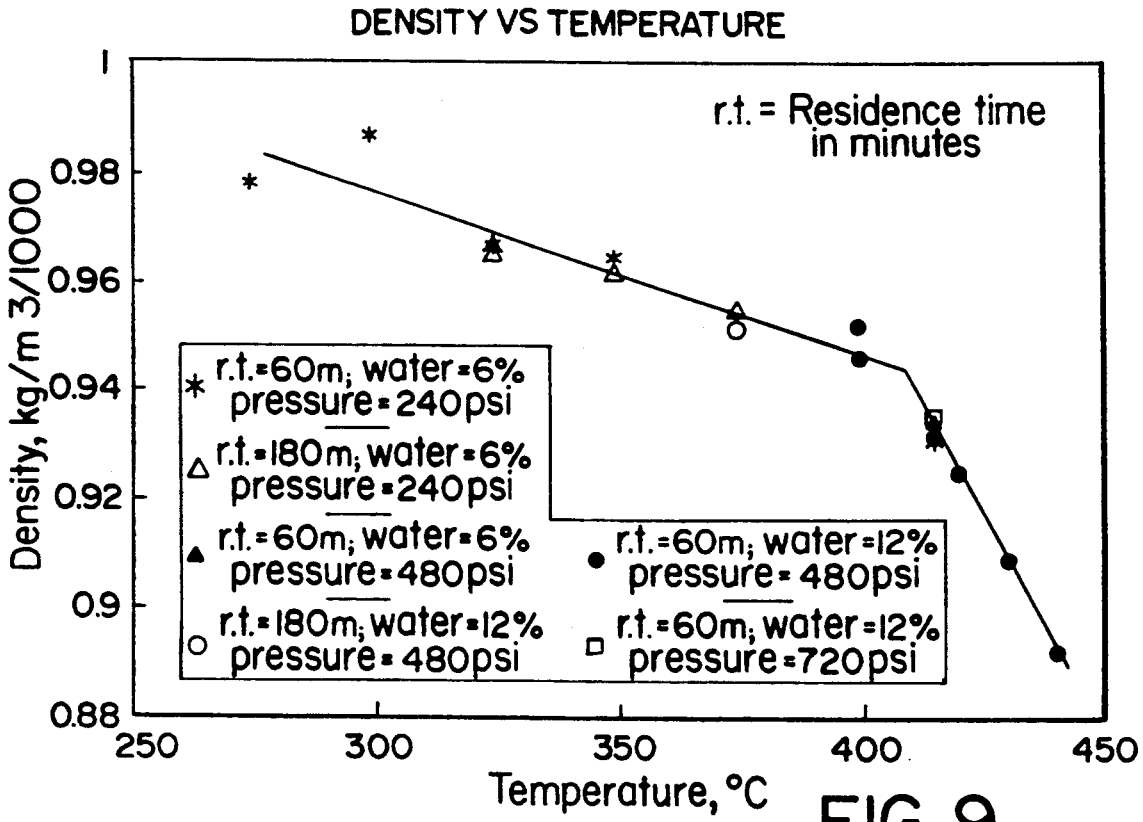
FIG. 9 is a graph of density, in kg/m$^3$/1000 as ordinate vs temperature, in °C. in abscissa.

The product densities are given in FIG. 9. A relatively modest density decrease with temperature occurs up to approximately 400° C. consistent with minimal cracking. At higher temperatures extensive cracking starts to occur with the resultant more rapid decrease in density.

Figure 10:
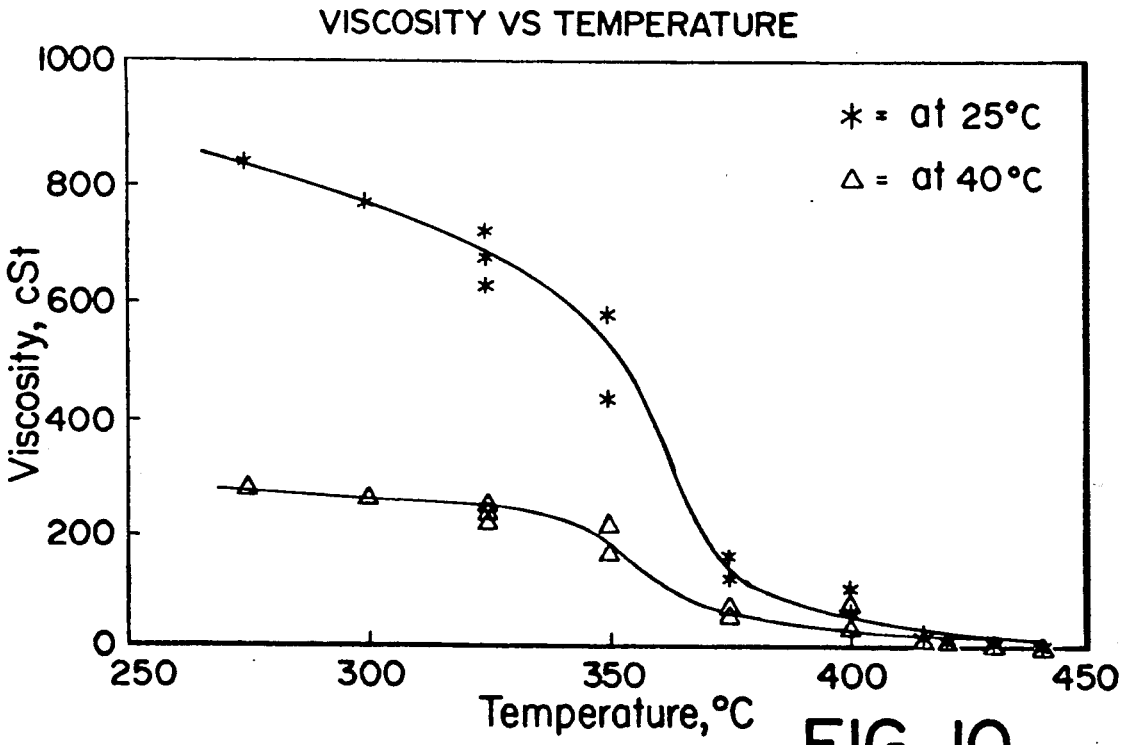
FIG. 10 is a graph of viscosity, in cSt as ordinate vs temperature, in °C. as abscissa.

For the combined emulsion breaking/viscosity reduction process, there is a limitation on temperature, i.e., limitation on the extent of cracking. However, despite this, the process results in a surprisingly large reduction in viscosity, as evidenced by the graph of viscosity versus temperature as shown in FIG. 10. Particularly in the temperature range 330°-390° C., a large drop in viscosity occurs even though extensive thermal cracking, as exemplified by the pitch conversion and gas make, hardly takes place.

The data indicates that it is relatively easy to meet the viscosity specifications of 88.8 and 43.5 cSt at 25° C. and 40° C., respectively. A minimum temperature of 390° C.-400° C. should be sufficient. However, to reach the maximum density of 0.934 kg/L a minimum temperature of 415° C. appears necessary.

The operating conditions for the semi-continuous runs are given below in Table 6:

TABLE 6

| | Operating Conditions For Semi-Continuous Runs | | | |
|---|---|---|---|---|
| Feedstock | Pelican | Tangle-flags | Wolf Lake | Cold Lake |
| Temperature, C. | 420 | 420 | 425 | 425 |
| Residence time, min | 90 | 75 | 90 | 90 |
| $CO/H_2O$ ratio | 0.71 | 0.45 | 0.91 | 0.45 |
| Pressure, | | | | |
| MPa | 7.0 | 7.3 | 7.1 | 7.2 |
| psig | 1010 | 1040 | 1015 | 1025 |
| Water content, wt % | 7.6 | 19.4 | 4.9 | 31.8 |

The temperatures chosen for the semi-continuous runs were somewhat higher to allow for the semi-continuous nature of the experiments which resulted in a lower carbon monoxide/hydrogen ration and removal of the lighter materials from the reactor. The reaction temperatures for Wolf Lake and Cold Lake were chosen somewhat higher because of the lower quality of these feedstocks.

Some typical yields and conversions from semi-continuous runs are given below in Table 7:

TABLE 7

| | Yields and Conversions For Semi-Continuous Runs | | | |
|---|---|---|---|---|
| | Pelican | Tangle-flags | Wolf Lake | Cold Lake |
| Yields, wt % from GC | | | | |
| Naphtha, IBP-200 C. | 14.34 | 12.9 | 15.39 | 11.58 |
| LGO, 200-360 C. | 31.95 | 37.35 | 33.72 | 29.95 |
| HGO, 360-500 C. | 19.99 | 20.97 | 16.39 | 17.44 |
| Pitch, +500 C. | 33.70 | 28.78 | 34.49 | 41.03 |
| Yields, wt %, distillation | | | | |
| Gas, C1-C3 | 2.85 | 2.37 | 3.95 | 3.97 |

TABLE 7-continued

| | Yields and Conversions For Semi-Continuous Runs | | | |
|---|---|---|---|---|
| | Pelican | Tangle-flags | Wolf Lake | Cold Lake |
| Light Naphtha, C4-C6 | 2.73 | 3.08 | 4.11 | 4.05 |
| Naphtha, IBP-200 C. | 15.00 | 13.27 | 16.46 | 12.49 |
| LGO, 200-360 C. | 35.90 | 38.31 | 34.78 | 35.75 |
| HGO, 360-500 C. | 16.42 | 15.21 | 9.66 | 14.45 |
| Pitch, 500+ C. | 23.00 | 23.15 | 20.38 | 22.18 |
| Pitch conversion, wt %, based on distillation | 49.25 | 50.22 | 54.91 | 57.61 |
| Hydrogen consumption, scf/bbl | 229 | 101 | 176 | 189 |
| Density, $kg/m^3/1000$ | | | | |
| as recovered | 0.9364 | 0.9280 | 0.9298 | 0.9457 |
| including $C_4+$ | 0.9232 | 0.9143 | 0.9108 | 0.9256 |
| Viscosity, cSt | | | | |
| 25 C. | 16.1 | 16.4 | 10.0 | 19.87 |
| 40 C. | 9.35 | 9.88 | 4.56 | 10.59 |

The yields (on GC), conversion, density ($C_4+$) and viscosity for Pelican show the utility of the present invention. Products from these runs were analyzed more fully and some results for the whole oils are compared with the original feeds in Table 8, below:

TABLE 8

| | Comparison of Feed and Product Properties | | | |
|---|---|---|---|---|
| | Pelican | Tangle-flags | Wolf Lake | Cold Lake |
| Density, kg/L | | | | |
| feed | 0.9682 | 0.9850 | 0.9961 | 1.0095 |
| Product | 0.9364 | 0.9280 | 0.9298 | 0.9438 |
| including $C_4+$ | 0.9232 | 0.9143 | 0.9108 | 0.9256 |
| Desulphurization, % | 19.8 | 29.2 | 26.6 | 21.1 |
| max. possible | 27.5 | 36.6 | 40.4 | 31.9 |
| Denitrogenation, % | 11.0 | 31.2 | 36.7 | 20.7 |
| Conradson carbon conversion, % | 19.6 | 40.0 | 37.9 | 28.4 |
| Asphaltene conversion, % | 56.8 | 68.8 | — | — |
| Viscosity, cSt 40 C. | | | | |
| feed | 342.0 | 2753 | 5278 | 35596 |
| product | 9.35 | 9.88 | 4.56 | 10.59 |
| Demetallization, % Vanadium | 87 | 74 | — | 83 |

From these results, it is seen that the densities of the recovered liquid are still too high for Pelican and Cold Lake, though, if the light naphtha recovered with the gases is included, all products easily meet this specification. This fact also would improve the batch results. The data further indicates that significant desulphurization and denitrogenation have occurred. The number given assumes all gases and $C_4+$ have the same composition as the liquid; the number "max. possible" assumes the gases and $C_4+$ have no sulphur and thus indicates the maximum sulphur conversion obtainable. In addition, appreciable CCR removal has occurred. The high demetallization is particularly noteworthy and shows that the process can be operated at relatively mild conditions and remove the great majority of all metals present.

OPERATION OF PREFERRED EMBODIMENTS

In summary, the data indicate that the water-gas shift reaction occurs rapidly at very modest temperatures and supplies more hydrogen than is taken up by the hydrogenation reactions.

A simple low severity process for simultaneously breaking and upgrading heavy oil emulsions, has therefore been provided by the present invention. The process uses the water present in the emulsion to provide the hydrogen for hydrogenation and combines into one process, the two processes of water removal from the emulsion and upgrading of the heavy oil to pipeline specifications. The net hydrogen production can be used, for example to hydrotreat secondary streams in an integrated plant. The hydrogen production (water-gas shift reaction) is influenced by operating conditions, e.g. CO and water concentrations and residence times. However, the water-gas shift reaction appears to reach equilibrium at 380° C.–400° C. Conversely, the pitch conversion is only influenced by the residence time. By proper selection of the operating conditions, viscosities and densities were obtained that were lower than the pipeline specifications without significantly breaking up the oil molecules into small fragments. Any traces of water remaining separated easily. Simultaneously, significant levels of desulphurization, denitrogenation, demetallization, CCR removal and asphaltene reduction were obtained. At higher temperatures, when significant cracking is not a concern, the process still results in a net production of hydrogen. In both process schemes, the hydrogen and carbon dioxide can be separated and used in other processes.

CONCLUSION

From the foregoing description, one skilled in the art can easily ascertain the essential characteristics of this invention, and without departing from the spirit and scope thereof, can make various changes and modifications of the invention to adapt it to various usuages and conditions. Consequently, such changes and modifications are properly, equitably, and "intended" to be, within the full range of equivalence of the following claims.

We claim:

1. A process for the thermal rearrangement of heavy oils in heavy oil-in-water emulsions, which process comprises: contacting said emulsion with carbon monoxide under such conditions of pressure and temperature that a water gas shift reaction occurs; and recovering thermally rearranged liquid oil having a lower viscosity and lower density, and separate streams of gaseous carbon dioxide and gaseous hydrogen therefrom.

2. The process of claim 1 carried out in the presence of a catalyst that facilitates the water gas shift reaction and promotes the hydrogenation and stabilization of cracking reaction products.

3. The process of claim 2 wherein said temperature is within the range of about 250° to about 460° C.

4. The process of claim 3 wherein said temperature is within the range of about 375° to about 400° C., thereby reducing both the viscosity and the density of said heavy oil, while minimizing cracking reactions.

5. The process of claim 3 wherein said temperature is within the range of about 400° to about 460° C.

6. The process of claim 3 wherein said pressure is within the range of about 100 to about 3000 psi.

7. The process of claim 6 wherein said pressure is within the range of about 500 to about 1500 psi.

8. The process of claim 2 wherein said process is carried out with a gas to liquid ratio within the range of about 9 l/kg to about 3500 l/kg.

9. The process of claim 2 wherein said process is carried out at a space velocity within the range of about 0.1 to about 20 per hour.

10. The process of claim 2 wherein said process is carried out at a residence time within the range of about 10 hours to about 3 minutes.

11. The process of claim 2 wherein said catalyst is an iron compound.

12. The process of claim 11 wherein said iron compound is iron oxide, iron sulphate, iron sulphide, an iron-containing waste material or a compound that converts to said iron compound within the process.

13. The process of claim 2 wherein said water gas shift catalyst is a Fe/Cr or Co/Mo catalyst.

14. The process of claims 11 or 13 wherein said catalyst is present in an amount of about 0.03 to about 5 wt %.

15. The process of claims 11 or 13 wherein a promotor is included to facilitate the water gas shift reaction.

16. The process of claims 11 or 13 wherein a promotor is included to facilitate the water gas shift reaction, said promotor being an alkali metal carbonate or an alkali metal sulphide.

17. The process of claims 11 or 13 wherein a promotor is included to facilitate the water gas shift reaction, said promotor being included in a ratio of about 0.01 to about 0:2 to said catalyst.

18. The process of claims 11 or 13 wherein a promotor is included to facilitate the water gas shift reaction, said promotor being potassium carbonate, which is included in a ratio of about 0.01 to about 0.2 to said catalyst.

19. The process of claim 2 wherein said process is carried out with a carbon monoxide/water ratio of about 0.3 to about 3.0.

20. The process of claim 2 wherein said carbon monoxide is in the form of a mixture of carbon monoxide and hydrogen.

21. The process of claim 2 including forming carbon monoxide in situ and then recovering excess carbon monoxide.

22. The process of claim 2 wherein said carbon dioxide produced is removed by a scrubbing process, by a pressure swing absorption process, or by a membrane separation process.

23. The process of claim 2 wherein said hydrogen produced is removed by a scrubbing process, by a pressure swing absorption process, or by a membrane separation process.

24. The process of claim 2 wherein said carbon dioxide produced is removed by a scrubbing process, by a pressure swing absorption process, or by a membrane separation process and wherein said hydrogen produced is removed by a scrubbing process, by a pressure swing absorption process, or by a membrane separation process.

25. The process of claim 2 wherein water present in said heavy oil/water emulsion is reacted to produce excess hydrogen.

26. The process of claim 2 wherein CO is produced in situ by the decomposition of a precursor thereof.

27. The process of claim 26 wherein said precursor is methanol.

28. The process of claim 2 wherein said process is carried out to effect a pitch conversion of less than about 20 wt %.

29. The process of claim 2 wherein the heavy oil includes metal impurities, and wherein said process is carried out to effect removal of substantially all of said metal impurities.

* * * * *